US006419130B1

(12) United States Patent
Chen

(10) Patent No.: US 6,419,130 B1
(45) Date of Patent: Jul. 16, 2002

(54) CONTAINER FOR DISPENSING A SMALL AMOUNT OF THE CONTENTS

(76) Inventor: Antony Chen, No. 863, Chienhsing Rd., North Dist., Taichung (TW)

( * ) Notice: Subject to any disclaimer, the term of this patent is extended or adjusted under 35 U.S.C. 154(b) by 0 days.

(21) Appl. No.: 09/985,504

(22) Filed: Nov. 5, 2001

(51) Int. Cl.[7] ..... G01F 11/28
(52) U.S. Cl. ..... 222/425; 222/434; 222/437
(58) Field of Search ..... 222/425, 434, 222/435, 437

(56) References Cited

U.S. PATENT DOCUMENTS 845,175 A * 2/1907 Hutchins ..... 222/425
1,084,757 A * 1/1914 Sanderson ..... 222/437
1,270,262 A * 6/1918 Buckland ..... 222/437
1,276,382 A * 8/1918 Loveland ..... 222/437
2,148,421 A * 2/1939 Allan ..... 222/437
2,204,104 A * 6/1940 Masters ..... 222/425
2,760,692 A * 8/1956 Buehlig ..... 222/434
3,016,170 A * 1/1962 Merkel ..... 222/425
3,097,769 A * 7/1963 Payne ..... 222/437

* cited by examiner

*Primary Examiner*—Kenneth Bomberg
(74) *Attorney, Agent, or Firm*—Rosenberg, Klein & Lee

(57) ABSTRACT

A container that can dispense a small amount of the contents has a body (10), a dispenser (20), a tube (30) and a cover (40). A baffle (24) is integrally formed in the dispenser (20) to close the opening between two ends of the dispenser (20). A tubular protrusion (25) integrally protrudes from the baffle (24) to form a passage between the two ends of dispenser (20). The tube (30) is adjustably inserted into the tubular protrusion (25) to define a first passage between the tube (25) and the cover (40). The cover (40) has an outlet (43) defined in the cover (40). A wall (42) extends downward from the cover (40) to define a U-shaped second passage between the first passage with the outlet (43). Consequently, a small amount of the contents can be poured out of the container, and the dispensed quantity of the contents is adjustable.

8 Claims, 7 Drawing Sheets

CONTAINER FOR DISPENSING A SMALL AMOUNT OF THE CONTENTS

BACKGROUND OF THE INVENTION

1. Field of the Invention

The present invention relates to a container, and more particularly to a container that can dispense a small amount of the contents from the container and adjust the amount of the contents dispensed.

2. Description of Related Art

Substances like sugar, beans, coffee, powder, pet food and washing powder are always kept in a container. When a person wants to use a small amount of the substance in the container, he or she often slightly tilts the container to pour a small quantity of the contents out of the container. However, the quantity of the substance dispersed from the container is not precisely controlled and is usually more than what is needed because the opening in the container is much larger than a single particle. In particular, a child has difficulty dispensing the correct amount of the contents from a conventional container, and an excess amount is easily poured out.

A conventional dispenser that can dispense a small amount of the contents from the container is disclosed in U.S. Pat. No. 5,711,463, "Distributor For Distributing A Small Amount Of Particles", issued on Jan. 27, 1998 to Chen et al. However, although the patented conventional dispenser can release a small amount of the contents from the container, there are so many elements in the conventional dispenser that the conventional dispenser is difficult to manufacture and assemble. The conventional dispenser is expensive to manufacture.

To overcome the shortcomings, the present invention tends to provide an improved container to mitigate or obviate the aforementioned problems.

SUMMARY OF THE INVENTION

The main objective of the invention is to provide an improved container that can dispense a precise amount of the contents and adjust the dispensed quantity of the contents. The container has a hollow body, a hollow dispenser, a tube and a cover. The hollow body has a top, a bottom and an opening defined in the top. The hollow dispenser is detachably attached to the body and has a bottom opening communicating with the opening in the body. A hollow extension integrally extends from the top of the dispenser and has a top opening defined in a top of the extension. A baffle is integrally formed in the dispenser to close the opening between the bottom opening in the dispenser and the top opening in the extension. A tubular protrusion integrally protrudes from the baffle and has a through hole defined through the protrusion to form a passage between the bottom opening in the dispenser and the top opening in the extension. The tube is adjustably inserted into the tubular protrusion and has a free end separated from the cover, such that a first passage is defined between the tube and the cover. The cover is attached to the extension to close the top opening and has an outlet defined in the cover. A wall extends downward from the cover and has a free end separated from the baffle so as to define a U-shaped second passage in the extension between the first passage with the outlet in the cover. With such a container, a small amount of the contents can be poured out of the container through the passages. In addition, the width of the first passage can be adjusted by adjusting the height of the tube. The dispensed quantity of the contents can be adjusted. The use of the container is more versatile.

Other objects, advantages and novel features of the invention will become more apparent from the following detailed description when taken in conjunction with the accompanying drawings.

DETAILED DESCRIPTION OF PREFERRED EMBODIMENT

Figure 1:
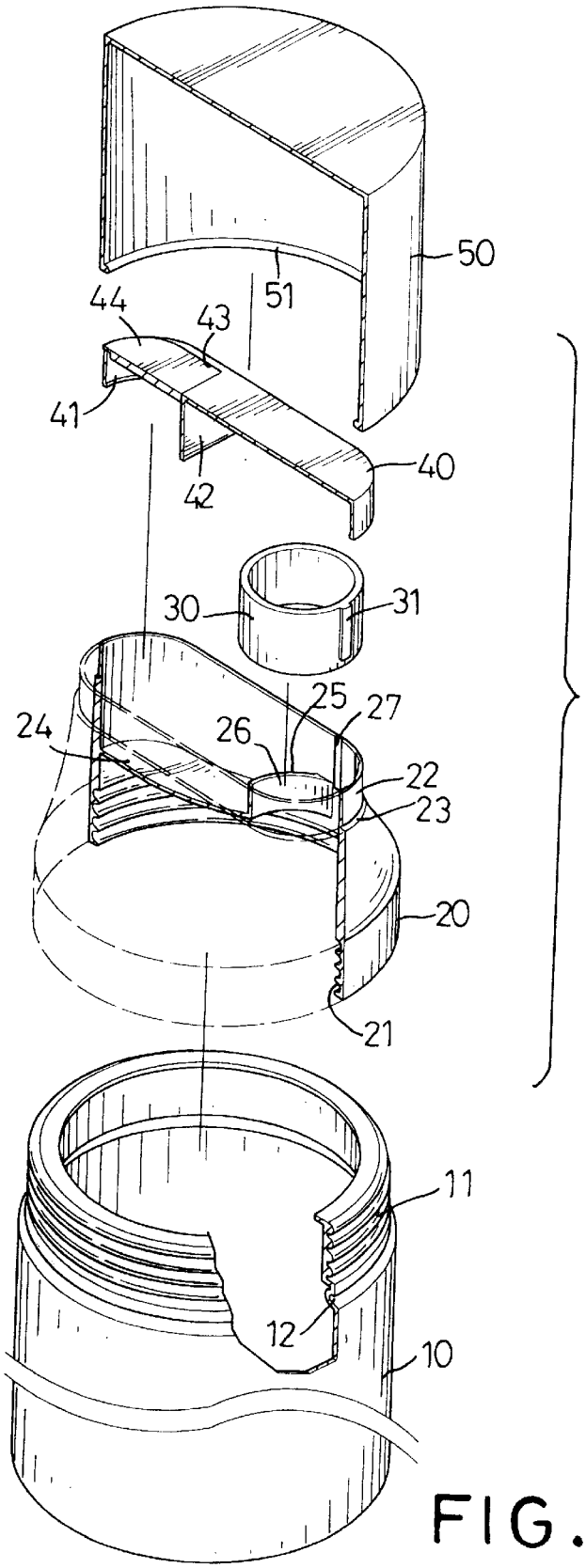
FIG. 1 is an exploded perspective view of a container that can dispense a small amount of the contents in accordance with the present invention.
Figure 2:
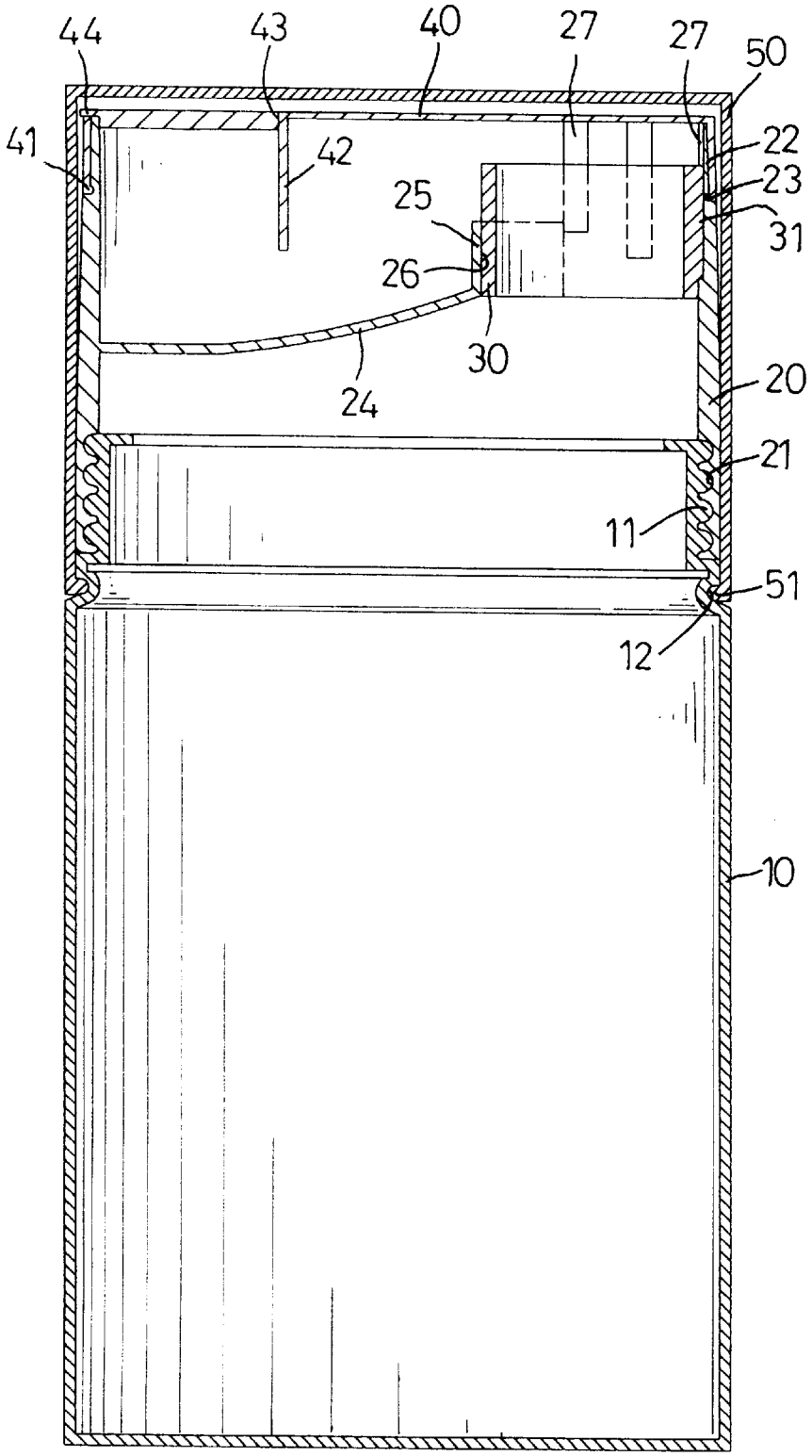
FIG. 2 is a cross sectional side plan view of the container in FIG. 1.
Figure 3:
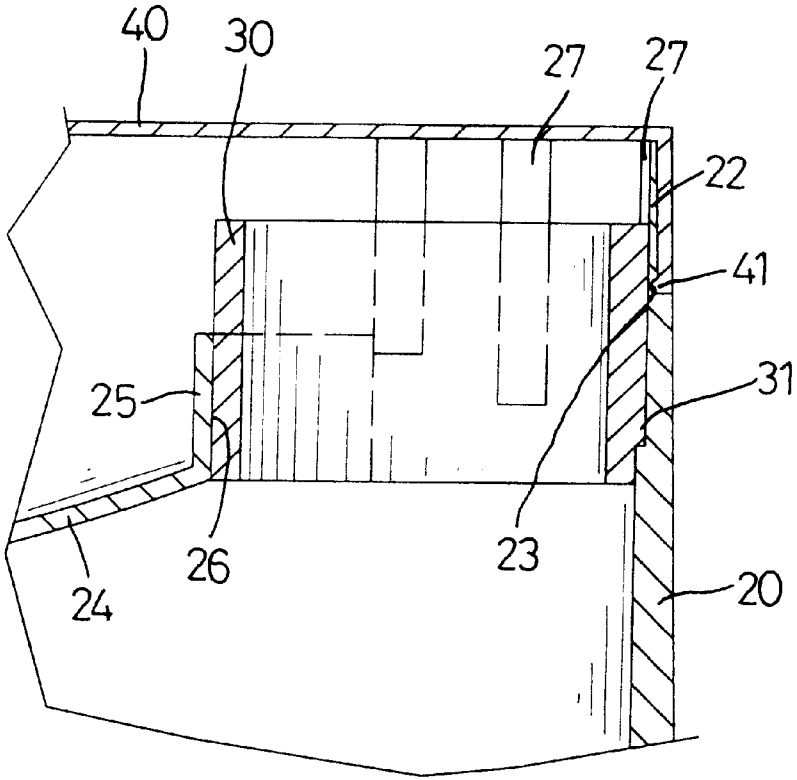
FIG. 3 is an enlarged cross section side plan view of the tube area in the dispenser in FIG. 2.

With reference to FIGS. 1 to 3, a container that can dispense a small amount of the contents in accordance with the present invention comprises a hollow body (10), a hollow dispenser (20), a cover (40) and a tube (30). The hollow body (10) is cylindrical and has an open top, a closed bottom and an inner and outer surface. A thread (11) is formed on the outer surface of the body (10) around the open top. A groove (12) is defined around the outer surface of the body (10) below the thread (11).

The hollow dispenser (20) has a top, an open bottom and an inner and outer surface. The open bottom corresponds to the open top in the body (10), is detachably attached to the body (10) and communicates with the open top in the body (10). An inner thread (21) is defined in the inner surface of the open bottom to screw onto the thread (11) on the body (10). Consequently, the dispenser (20) is detachably attached to the body (10) by the engagement between the thread (11) on the body (10) and the inner thread (21) on the dispenser (20).

An extension (22) integrally extends from the top of the dispenser (20). An opening is defined in the top of the extension (22). The extension (22) has an elongated circular shape. The dispenser (20) has a conical portion (not numbered) formed between the bottom of the dispenser (20) and the elongated extension (22). A groove (23) is defined around the outer surface of the dispenser (20) at the junction between the extension (22) and the conical portion.

A baffle (24) is integrally formed in the dispenser (20) to partially close the opening between bottom opening in the dispenser (20) and the top opening in the extension (22). A tubular protrusion (25) integrally protrudes from the baffle (24). A through hole (26) is defined through the protrusion (25) to provide a passage between the bottom opening in the dispenser (20) and the top opening in the extension (22).

The cover (40) is attached to the extension (22) to close the top opening in the extension (22). The cover (40) has a skirt (not numbered) and a top corresponding to the shape of the extension (22) and is an elongated circular shape. The cover (40) has two ends with one end corresponding to the tubular protrusion (25). The skirt has a top edge attached to the top of the cover, a bottom edge, an inside and an outside. A lip (41) extends around the inside of the bottom edge of the cover (40) to engage the groove (23) in the dispenser (20), such that the cover (40) is detachably connected to the dispenser (20). An outlet (43) is defined in the cover (40) at the end opposite to the tubular protrusion (25). A lid (44) is mounted on the cover (40) to close the outlet (43).

The tube (30) has a connected end and a free end and is adjustably inserted into the tubular protrusion (25). The free end of the tube (30) is separated from the cover (40) to define a first passage (not numbered) between the tube (30) and the cover (40). Multiple longitudinal keyways (27) are defined in the inner surface of the extension (22), and each keyway (27) has a length different from that of the other keyways (27). The tube (30) has a longitudinal key (31) integrally formed on the outer surface of the tube (30) to be received in one of the keyways (27). When the key (31) is inserted into one of the keyways, the height of the tube (30) with respect to the tubular protrusion (25) will depend on the length of the particular keyway (27). Consequently, the distance between the free end of the tube (30) and the cover (40) is adjustable, which makes the width of the first passage adjustable.

In addition, a wall (42) extends down from the cover (40) to divide the elongated circular cover (40) into two compartments. The free end of the wall (42) is separated from the baffle (24) to form a U-shaped second passage (not numbered) in the extension (22) between the first passage and the outlet (43) in the cover (40).

Furthermore, a top cap (50) is detachably attached to the body (10) over the dispenser (20) and the cover (40). A lip (51) extends around the bottom of the top cap (50) to engage with the groove (12) in the body (10), such that the top cap (50) is detachably attached to the body (10).

Figure 4:
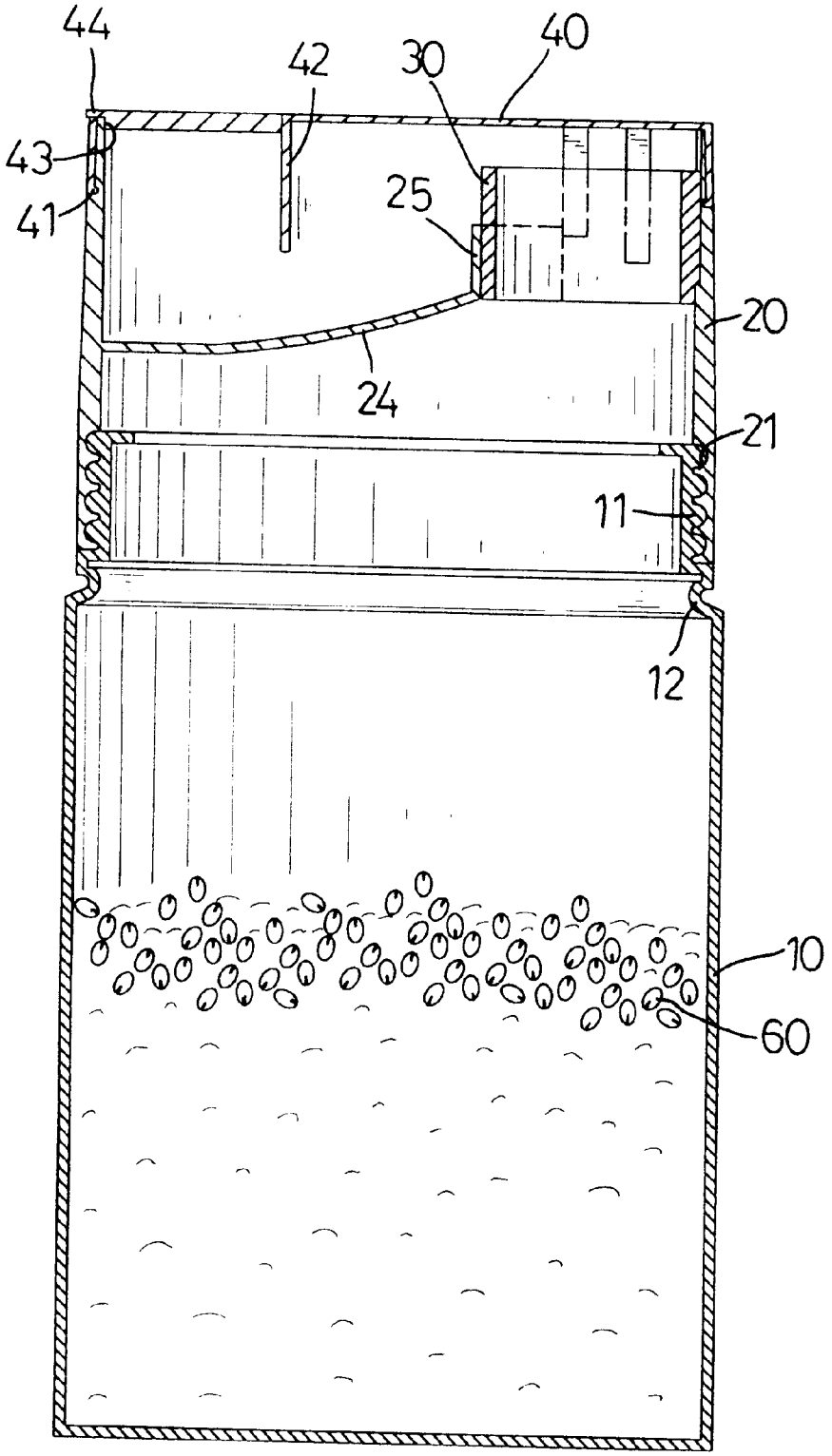
FIG. 4 is a cross section side plan view of the container in FIG. 1 with a substance in the container.

With reference to FIG. 4, because the dispenser (20) is detachably attached to the body (10), the dispenser (20) can be detached from the body (10) and the open top of the body (10) is exposed. Sugar, beans, coffee, powder, pet food, washing powder or any other dry substance that can be poured can be put into the body (10) through the open top in the body (10). After reattaching the dispenser (20) to the body (10), the contents are held in the container.

Figure 5:
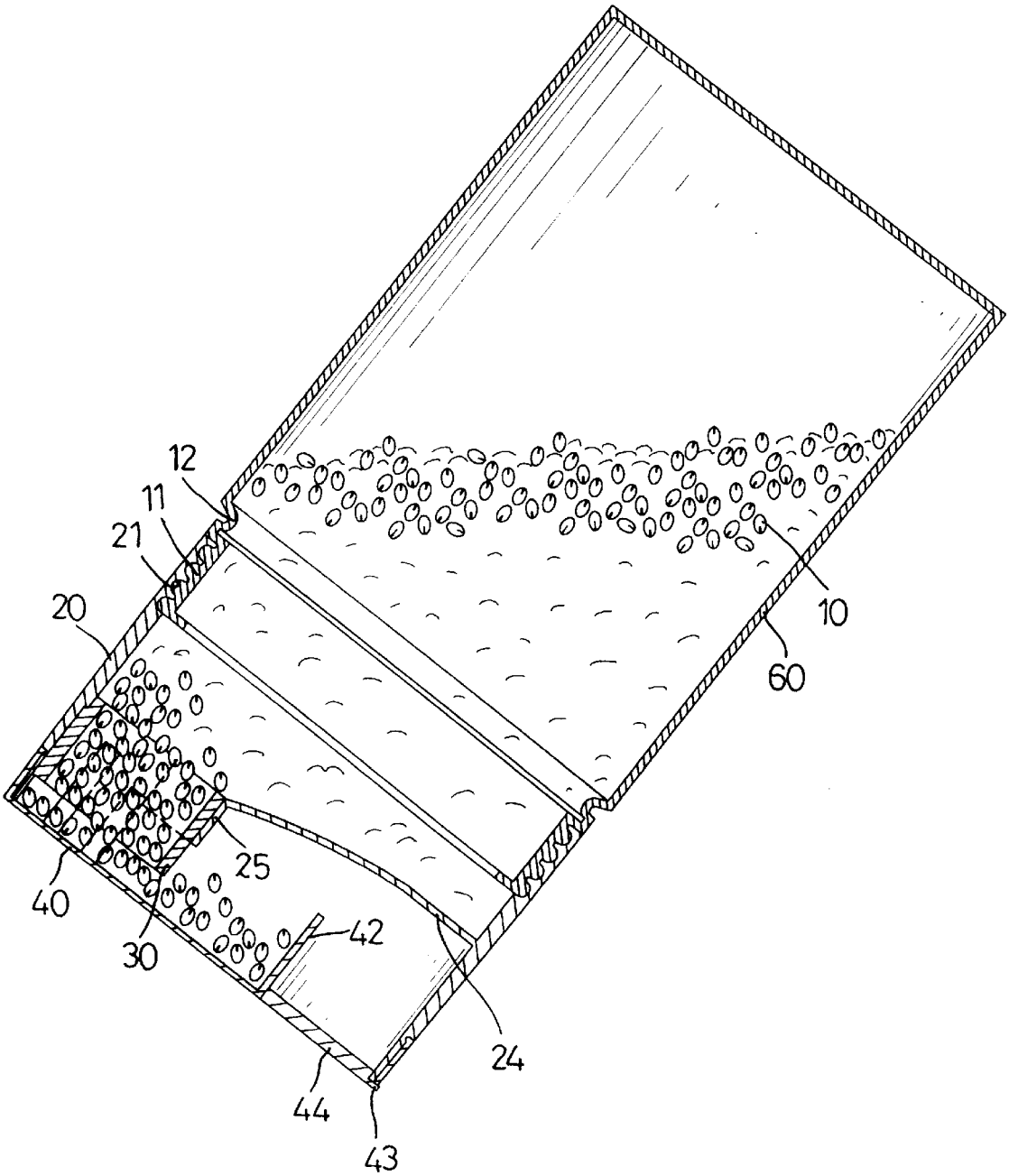
FIG. 5 is an operational cross sectional side plan view of the container in FIG. 4 dispensing some of the substance into the first passage.
Figure 6:
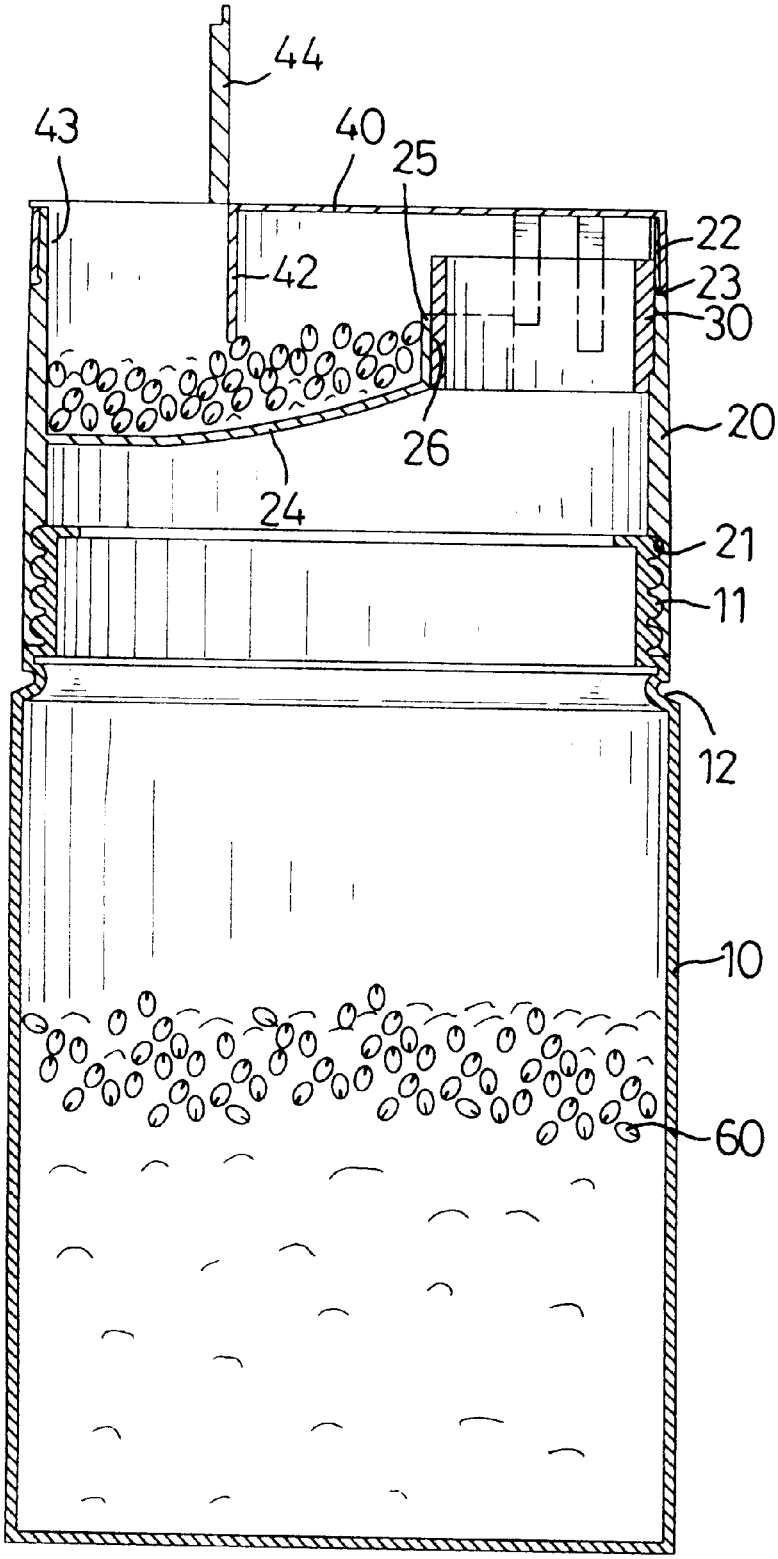
FIG. 6 is an operational cross sectional side plan view of the container in FIG. 5 with a small amount of the contents in the second passage.
Figure 7:
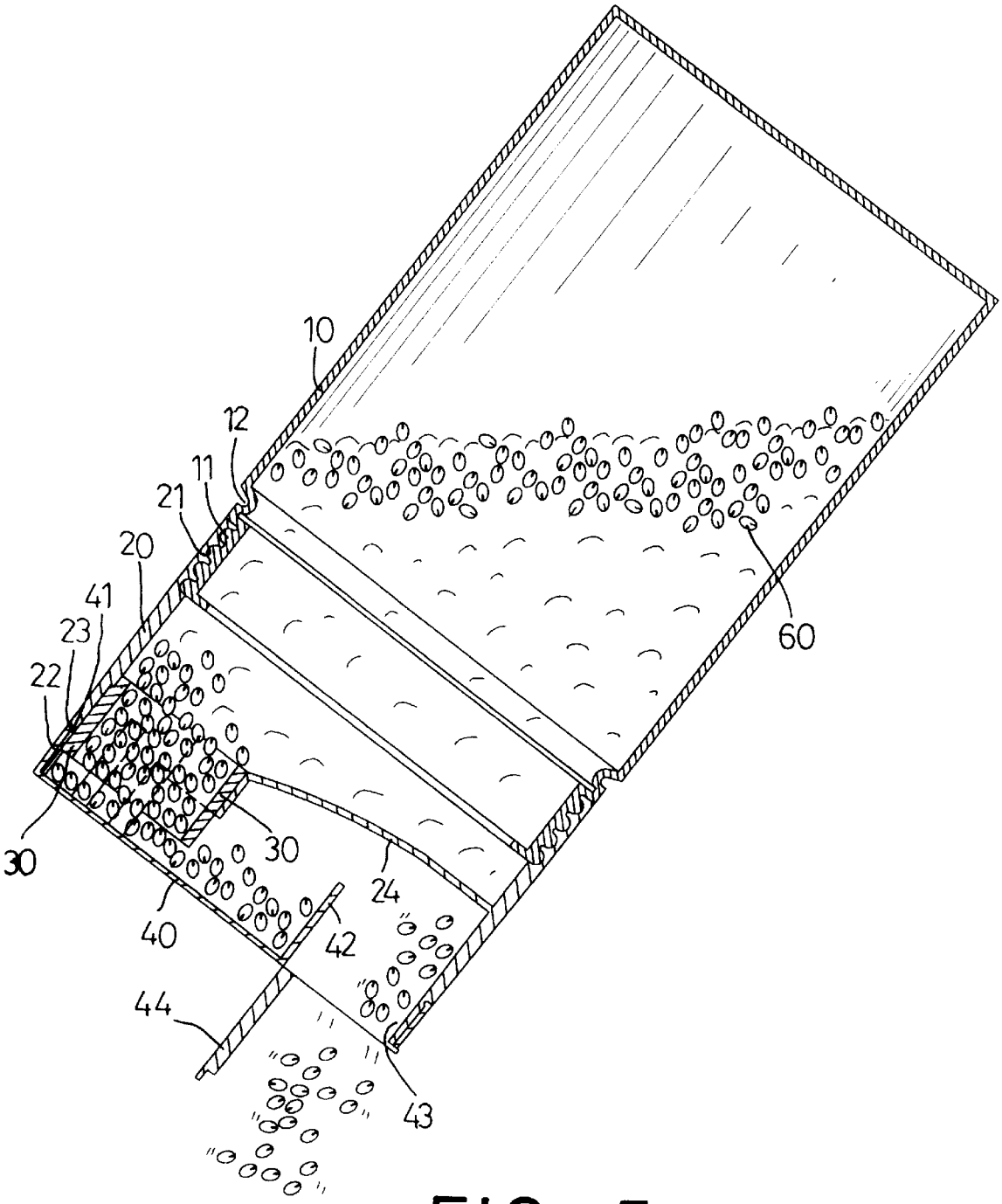
FIG. 7 is an operational cross sectional side plan view of the container in FIG. 6 showing the small amount of the contents being dispensed from the second passage.

With reference to FIGS. 2 and 5 to 7, when the user wants to dispense some of the contents from the container, he or she removes the top cap (50) first. Next, he or she turns the container upside down. Some of the contents go into the dispenser (20) through the through hole (26) in the tube (25) to fill the first passage, as shown in FIG. 5. A small amount enters the second passage and is stopped by the baffle (24). When the user turns the container right side up again, as shown in FIG. 6, the contents stopped by the baffle (24) will drop into the second passage, and the content in or over the first passage drops back into the body (10) through the dispenser (20). After opening the outlet (43) in the cover (40), the small amount of the contents can be poured out of the outlet (43) through the second passage when the user turns the container upside down again as shown in FIG. 7. Accordingly, a small amount of the contents will be dispensed from the container each time the user turns the container upside down. A desired small amount of the contents is conveniently dispensed from the container without using a measuring implement.

In addition, the quantity of the contents that drops into the second passage is determined by the width of the first passage, and the width of the first passage is adjustable. Therefore, the quantity of contents dispensed each time is adjustable and controllable by means of adjusting the position of the tube (30). The use of the container becomes more versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A container comprising:

a hollow body with a top and a bottom having an opening defined in the top of the body;

a hollow dispenser with a top and a bottom opening detachably attached to the body to communicate with the opening in the body;

a hollow extension integrally extending from the top of the dispenser and having a top opening defined in the extension;

a baffle integrally formed in the dispenser to separate the bottom opening in the dispenser and the top opening in the extension;

a tubular protrusion integrally protruding from the baffle and having a through hole defined in the protrusion to form a passage between the bottom opening in the dispenser and the top opening in the extension;

a cover attached to the extension to close the top opening in the extension and having an outlet defined in the cover at an end away from the tubular protrusion;

a tube adjustably inserted into the tubular protrusion and having a free end separated from the cover to define a first passage between the tube and the cover;

a wall extending downward from the cover and having a free end separated from the baffle so as to define a U-shaped second passage in the extension between the first passage with the outlet in the cover.

2. The container as claimed in claim 1, wherein the extension has multiple longitudinal keyways defined in an inner surface of the extension;

each keyway has a length different from that of the other keyways; and the tube has a key integrally formed on an outer surface of the tube and selectively engaging with one of the keyways;

whereby the tube can be adjustably inserted into the protrusion at a different height as the key engages a particular keyway.

3. The container as claimed in claim 1, wherein the body has a thread formed on an outer surface of the body around the opening in the body; and the dispenser has an inner thread defined in an inner surface of the dispenser to screw onto the thread on the body.

4. The container as claimed in claim 1, wherein the extension has an elongated circular cross section;

the dispenser has a conical portion between the bottom opening of the dispenser and the elongated circular extension; and the cover is in an elongated circular shape to fit with the elongated circular extension.

5. The container as claimed in claim 4, wherein the dispenser has a groove defined around an outer surface of the dispenser between the extension and the conical portion; and the cover has a lip extending from a bottom of the cover to engage with the groove in the dispenser to detachably attach the cover to the dispenser.

6. The container as claimed in claim 1 further comprising a lid mounted on the cover to close the outlet.

7. The container as claimed in claim 1 further comprising a top cap detachably attached to the body over the dispenser and the cover.

8. The container as claimed in claim 7, wherein the body has a groove defined around an outer surface of the body; and the top cap has a lip extending from a bottom of the top cap to engage with the groove in the body so as to detachably attach the top cap to the body.

* * * * *